US008517636B2

(12) United States Patent
Wrigley et al.

(10) Patent No.: US 8,517,636 B2
(45) Date of Patent: Aug. 27, 2013

(54) GAS-CYLINDER RETAINING ASSEMBLY

(75) Inventors: Gordon Wrigley, Tyne and Wear (GB); Paul Townsend, Northumberland (GB)

(73) Assignee: Draeger Safety UK Limited, Blyth (Northumberland) (GB)

( * ) Notice: Subject to any disclaimer, the term of this patent is extended or adjusted under 35 U.S.C. 154(b) by 326 days.

(21) Appl. No.: 12/773,413

(22) Filed: May 4, 2010

(65) Prior Publication Data

US 2010/0282793 A1 Nov. 11, 2010

(30) Foreign Application Priority Data

May 6, 2009 (GB) ..... 0907741.3

(51) Int. Cl.
*A44B 11/00* (2006.01)
*A45F 5/00* (2006.01)
*B63C 11/08* (2006.01)

(52) U.S. Cl.
USPC ..... 405/186; 441/116; 24/265 BC; 224/934

(58) Field of Classification Search
None
See application file for complete search history.

(56) References Cited

U.S. PATENT DOCUMENTS

| | | | | |
|---|---|---|---|---|
| 4,310,110 | A | 1/1982 | Dexter | |
| 4,455,718 | A * | 6/1984 | Finnern | 405/186 |
| 5,370,286 | A * | 12/1994 | Newman | 224/578 |
| 6,772,485 | B2 * | 8/2004 | Alpert | 24/300 |
| 2002/0111096 | A1 | 8/2002 | Kawashima et al. | |
| 2006/0032028 | A1 * | 2/2006 | Takeuchi et al. | 24/197 |

FOREIGN PATENT DOCUMENTS

| | | | |
|---|---|---|---|
| DE | 299 06 815 | U1 | 8/1999 |
| GB | 2020729 | A | 11/1979 |
| WO | 2009022256 | A1 | 2/2009 |

OTHER PUBLICATIONS

Search report under Section 17 for GB0907741.3, date of search Aug. 21, 2009, 1 p.
Chinese Office Action issued in corresponding Chinese Patent Application No. 201010165739.X.

* cited by examiner

*Primary Examiner* — Jack W. Lavinder
(74) *Attorney, Agent, or Firm* — DLA Piper LLP (US)

(57) ABSTRACT

The present invention relates to a gas-cylinder retaining assembly 10 for retaining a gas-cylinder on a harness for breathing apparatus. The retaining assembly comprises a strap 20 arranged in use to be coupled to the harness and a retaining portion of which is arranged to pass around at least a portion of the cylinder; a tensioning device 30 arranged for tightening the retaining portion of the strap around the cylinder such that the cylinder is held to the harness, and wherein a free portion of the strap, having a free end, extends from the tensioning device; and a retaining buckle 40 arranged for retaining the free portion of the strap, the retaining buckle 40 comprises a positioning slot 42 through which in use the retaining portion of the strap passes; a pivot member 44 which in use is located between the cylinder and the retaining portion of the strap; and a retaining slot arranged in use to receive the free end of the strap 46. In use the retaining buckle 40 is pivotable between at least a loading position in which the free end of the strap can be inserted into the retaining slot, and a retaining position in which at least part of the free portion of the strap is held between the retaining buckle and the retaining portion of the strap.

9 Claims, 6 Drawing Sheets

GAS-CYLINDER RETAINING ASSEMBLY

This application is a utility application which claims the priority of United Kingdom Patent Application No. GB 0907741.3, filed May 6, 2009 incorporated herein by reference in its entirety.

BACKGROUND OF THE INVENTION

The present invention relates to a gas-cylinder retaining assembly for a harness for breathing apparatus, in particular, a gas-cylinder retaining assembly including a retaining buckle.

Self-contained breathing apparatus (SCBA) harnesses comprise a structural support member in the form of a back plate (or frame) to which a cylinder of breathable gas is mounted. The cylinder of gas is retained on the back plate using a flexible cylinder-retaining strap that is attached to the back plate and tensioned around the cylinder. A tensioning device is provided in order to tighten the strap around the cylinder and to maintain the tension in the strap. Depending on the size of the cylinder, a free, surplus portion of the strap usually extends from the tensioning device. This must be secured in order to reduce the risk of snagging the strap. In one known arrangement, this is done by using Velcro® to attach the free end of the strap to the portion of strap around the cylinder. Whilst this is satisfactory, the free end of the strap can become detached and loose, thereby introducing a potential hazard.

It is therefore desirable to provide an arrangement in which the free end of the cylinder-retaining strap is more securely retained.

SUMMARY OF THE INVENTION

According to one aspect of the present invention there is provided a gas-cylinder retaining assembly for retaining a gas-cylinder on a harness for breathing apparatus, comprising: a strap arranged in use to be coupled to the harness and a retaining portion of which is arranged to pass around at least a portion of the cylinder; a tensioning device arranged for tightening the retaining portion of the strap around the cylinder such that the cylinder is held to the harness, and wherein a free portion of the strap, having a free end, extends from the tensioning device; and a retaining buckle arranged for retaining the free portion of the strap, the retaining buckle comprising: a positioning slot through which in use the retaining portion of the strap passes; a pivot member which in use is located between the cylinder and the retaining portion of the strap; and a retaining slot arranged in use to receive the free end of the strap; wherein in use the retaining buckle is pivotable between at least a loading position in which the free end of the strap can be inserted into the retaining slot, and a retaining position in which at least part of the free portion of the strap is held between the retaining buckle and the retaining portion of the strap.

In one embodiment the pivot member of the buckle defines a side of the positioning slot. Preferably the positioning slot and the retaining slot are separate, preferably parallel, and preferably laterally spaced from one another.

In a preferred arrangement the pivot member is shaped such that the force acting on the pivot member due to the tension in the retaining portion of the strap causes the retaining buckle to be held in the retaining position.

In a preferred arrangement the tension in the retaining portion of the strap is increased when the retaining buckle is moved from the retaining position to the locating position.

The shape of the pivot member may be substantially that of a rectangular prism. At least a portion of the retaining buckle may be textured so as to grip the strap. The retaining buckle may be curved so as to follow the surface contour of the gas-cylinder when the buckle is in the retaining position. The retaining buckle may be made from plastics material.

According to a further aspect of the present invention there is provided a harness for breathing apparatus comprising a gas-cylinder retaining assembly according to any statement herein.

The invention may comprise any combination of the features and/or limitations referred to herein, except combinations of such features as are mutually exclusive.

BRIEF DESCRIPTION OF THE DRAWINGS

Embodiments of the present invention will now be described, by way of example only, with reference to the accompanying drawings, in which.

DESCRIPTION OF EMBODIMENTS OF THE INVENTION

Figure 1:
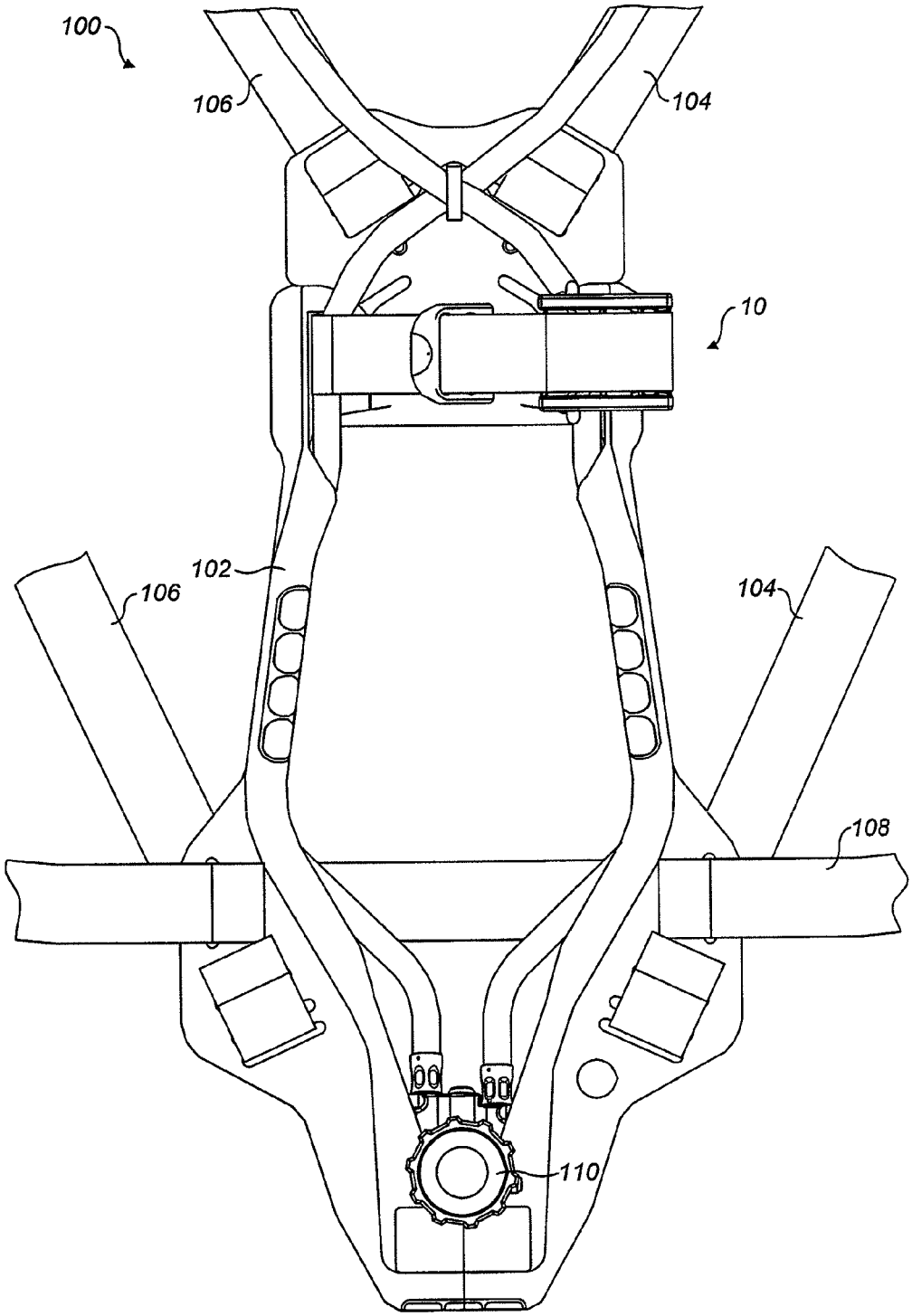
FIG. 1 schematically shows a harness for breathing apparatus having a gas-cylinder retaining assembly according to an embodiment of the present invention.
Figure 2:
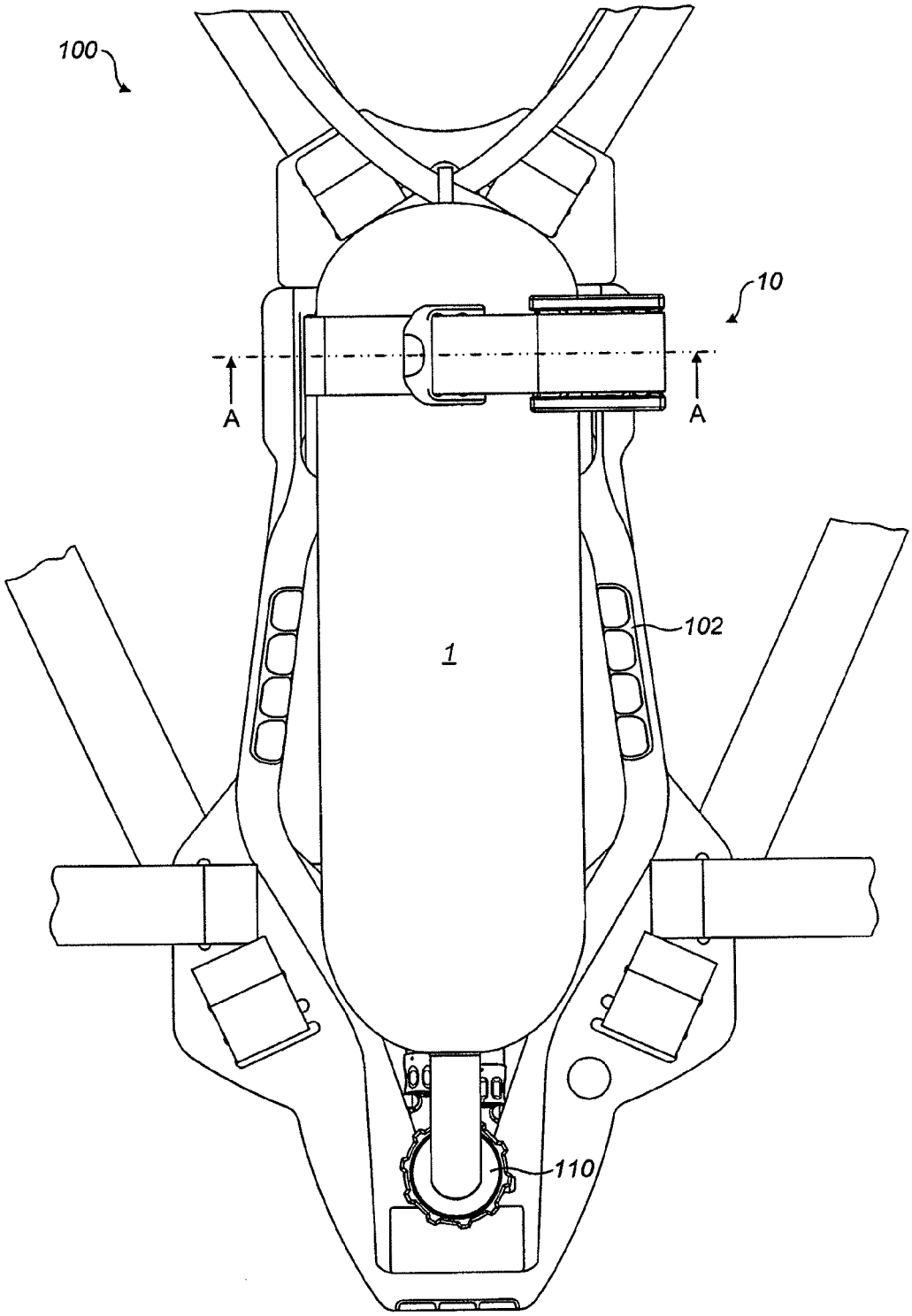
FIG. 2 schematically shows the harness of FIG. 1 with a gas cylinder attached thereto.

FIG. 1 shows a harness 100 for breathing apparatus comprising a back frame 102 (otherwise known as a back plate), two shoulder straps 104, 106, a waist strap 108, a reducer valve 110 and a cylinder retaining assembly 10. With reference to FIG. 2, in use, the gas cylinder valve 2 is attached to the reducer 110 and a gas cylinder 1 is secured against the back frame 102 using the cylinder retaining assembly 10.

Figure 3:
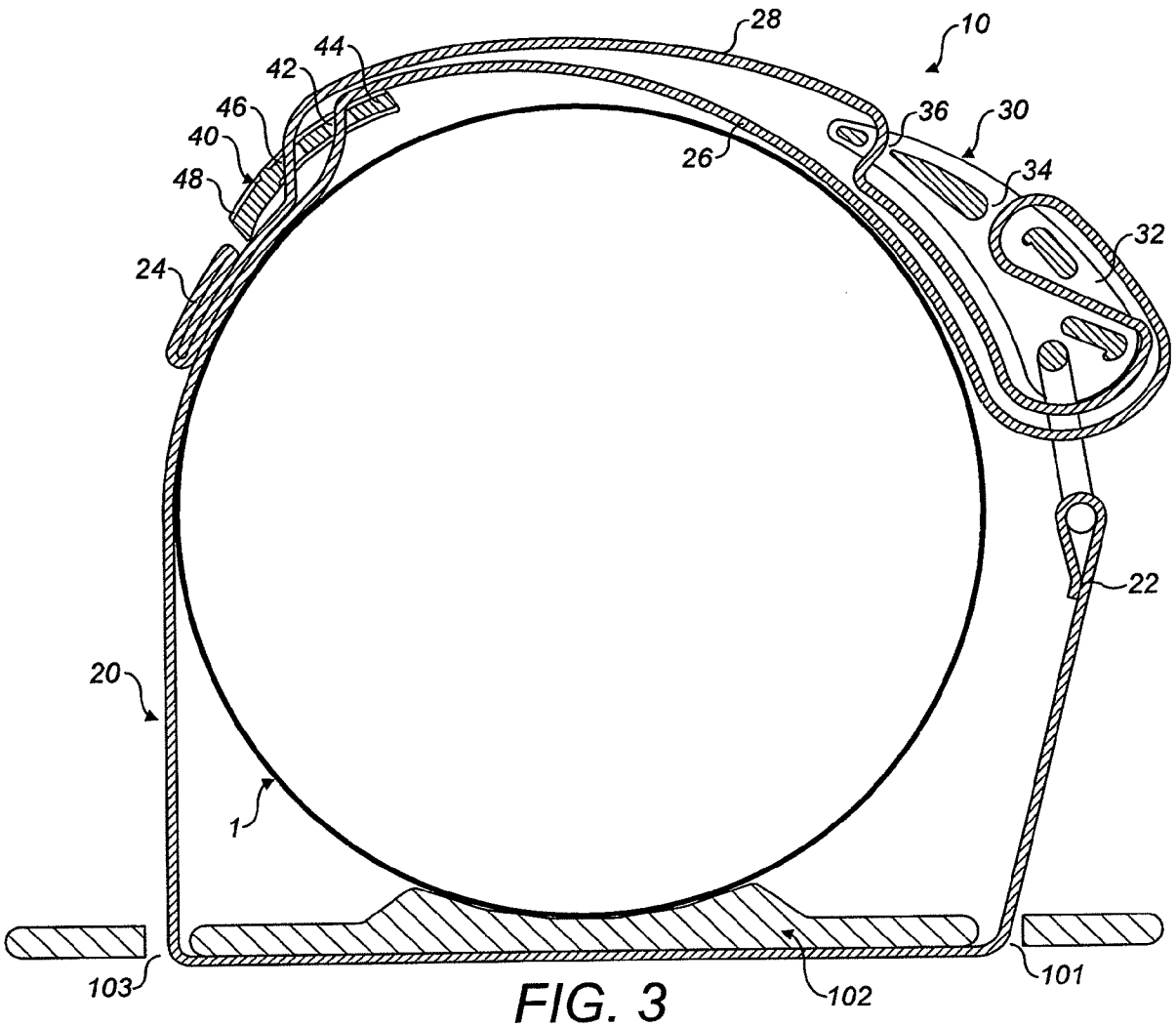
FIG. 3 shows schematically the cross-section A-A of FIG. 2.

As shown in FIG. 3, the gas cylinder retaining assembly 10 comprises a strap 20, a tensioning device 30 and a retaining buckle 40. The strap 20 is a continuous length of material that is attached to the tensioning device 30 at a first end 22 and has a second free end 24. The free end 24 is folded and stitched to prevent fraying of the strap. The strap 20 is attached to the back frame 102 of the harness 100 by passing the free end 24 through a first slot 101 at a first side of the back frame 102 and then through a second slot 103 at a second side of the back frame. The free end 24 of the strap 20 is then fed through a positioning slot 42 of the retaining buckle 40.

Figure 4:
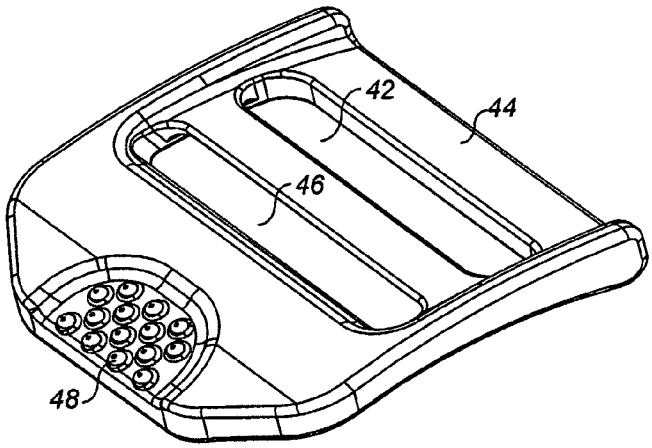
FIG. 4 schematically shows the retaining buckle of the gas-cylinder retaining assembly shown in FIG. 1.

FIG. 4 shows a detailed view of the retaining buckle 40. The retaining buckle 40 comprises a positioning slot 42, a pivot member 44 and a retaining slot 46. The positioning slot 42 and retaining slot 46 are laterally spaced from one another and are parallel. The pivot member 44 defines a side of the positioning slot 42. The retaining buckle 40 also comprises a tongue portion 48. The retaining buckle 40 is slightly curved along its length so that it conforms to the surface contour of the cylinder when it is in a retaining position (described in detail below).

The free end 24 of the strap 20 is then fed through three slots 32, 34, 36 in the tensioning device 30. The free end 24 of the strap 20 is pulled tightly through the tensioning device 30 so as to tension a retaining portion of strap 26 around the gas cylinder 1. This holds the cylinder 1 tightly against the back frame 102. A free, non-tensioned portion of strap 28 extends from the tensioning device 30. The retaining buckle 40 is then used to secure the free portion 28 of strap 20.

Figure 5:
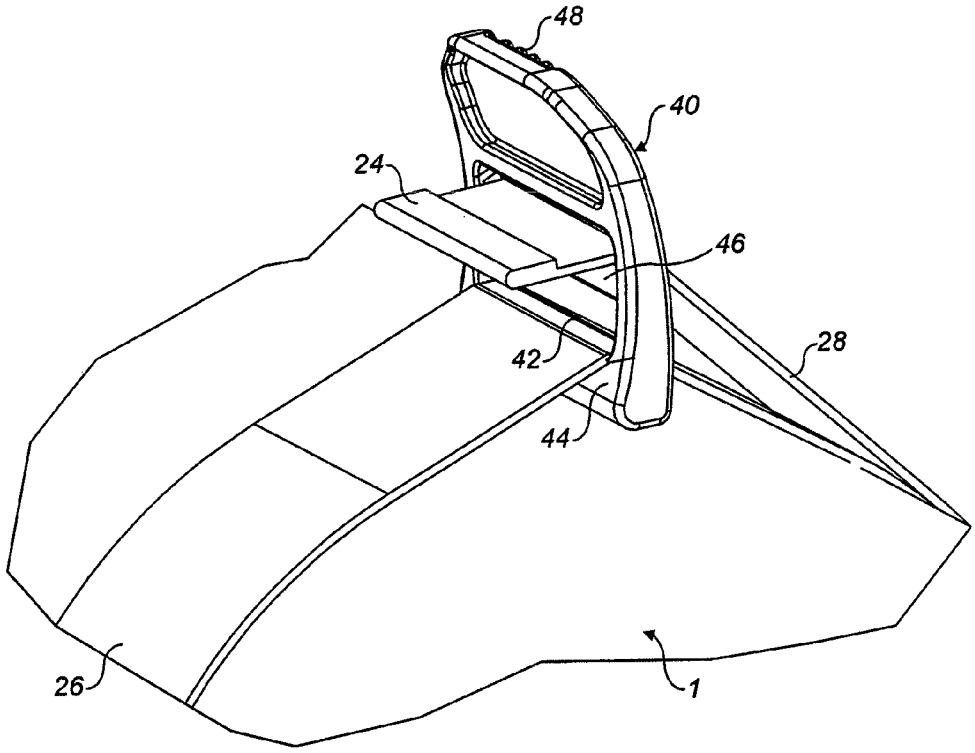
FIG. 5 schematically shows the retaining buckle of FIG. 4 in use in a loading position.
Figure 6:
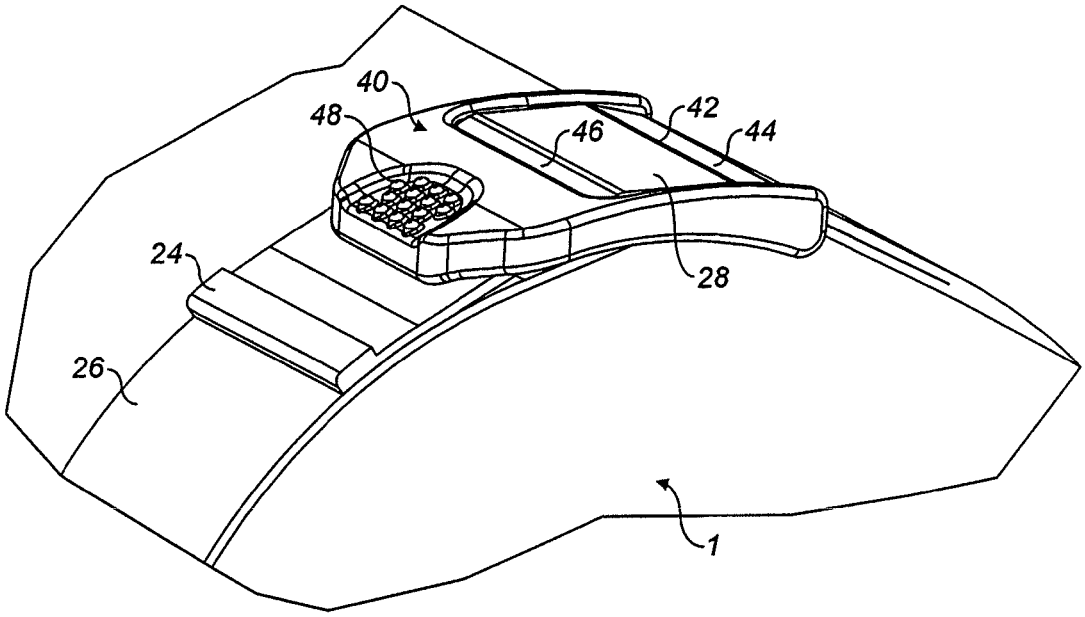
FIG. 6 schematically shows the retaining buckle of FIG. 4 in use in a retaining position.

The retaining buckle 40 is slid along the tensioned retaining portion of the strap 26 until it is in the proximity of the free end 24 of the strap 20. As shown in FIG. 5, the retaining buckle 40 is moved to a loading position in which it is approximately perpendicular to the cylinder. This is done by lifting the tongue 48 of the retaining buckle 40 which causes the retaining buckle 40 to pivot about the pivot member 44. The free end 24 of the strap 20 is then inserted into the retaining slot 46 of the retaining buckle. As shown in FIG. 6, the retaining buckle 40 is then moved to a retaining position by pushing down on the tongue 48 causing the retaining buckle 40 to pivot about the pivot member 44. A part of the free portion 24 of the strap 20 is now held between the underside of the tongue 48 and the tensioned retaining portion of the strap 26. This securely holds the free portion of the strap 24 in place.

Figure 7:
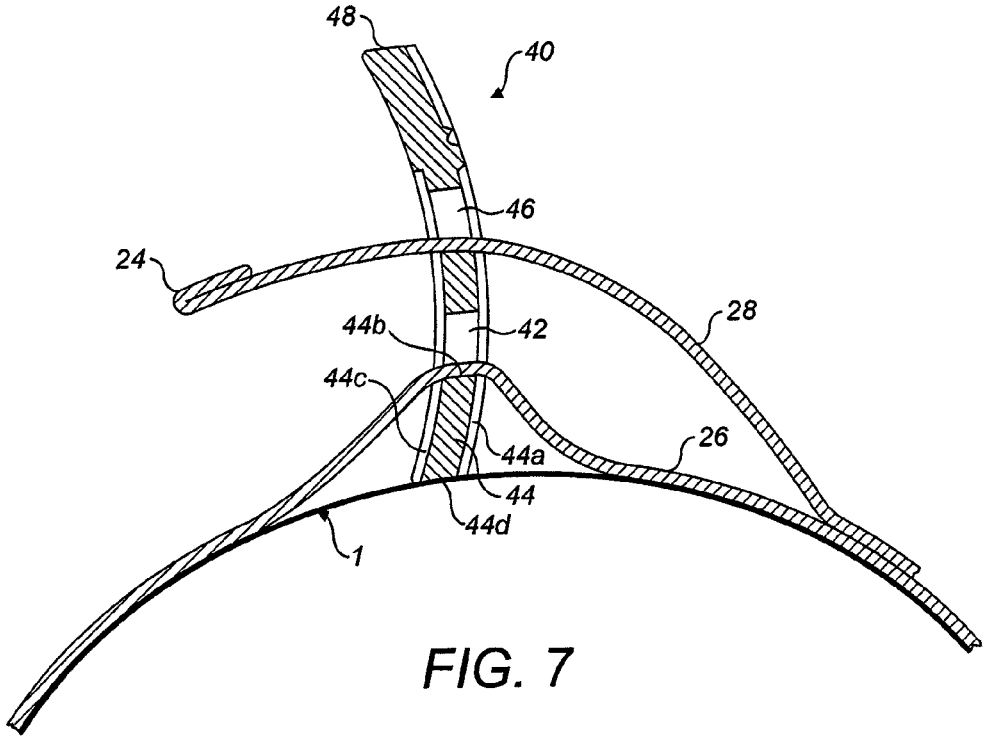
FIG. 7 schematically shows an enlarged view of the retaining buckle of FIG. 4 in a loading position.
Figure 8:
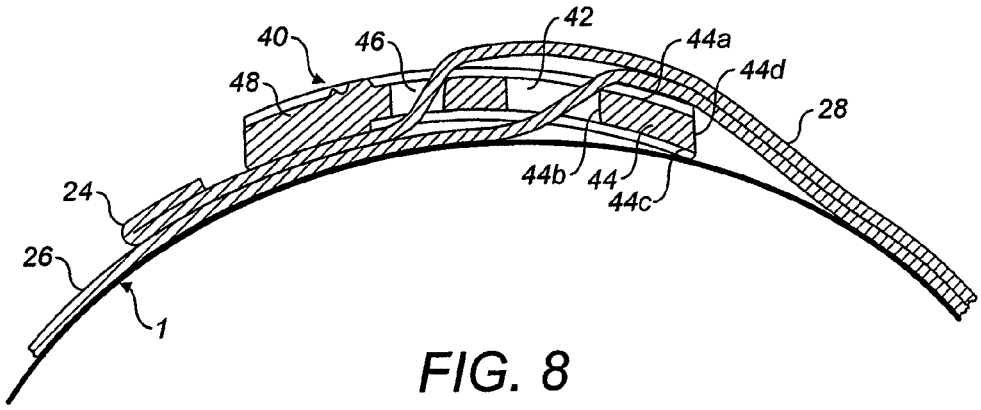
FIG. 8 schematically shows an enlarged view of the retaining buckle of FIG. 4 in a retaining position.

The operation of the retaining buckle 40 will now be explained in more detail with reference to FIGS. 7 and 8. As can be seen, in use the pivot member 44 of the retaining buckle 40 is located between the gas-cylinder 1 and the tensioned retaining portion 26 of the strap 20. The tensioned portion 26 of the strap therefore exerts a force on the pivot member 44 in a direction towards the cylinder. The pivot member 44 is substantially a rectangular prism and has first and third opposing sides 44*a*, 44*c* that are wider than second and fourth opposing sides 44*b*, 44*c*. When the retaining buckle 40 is in the loading position (FIG. 7) the second side 44*b* of the pivot member 44 is in contact with the tensioned portion 26 of the strap 20 and the fourth side 44*d* of the pivot member 44 is in contact with the cylinder 1. When the retaining buckle 40 is in the retaining position (FIG. 8) the first side 44*a* of the pivot member 44 is in contact with the tensioned portion 26 of the strap 20 and the third side 44*c* is adjacent the cylinder 1.

When the retaining buckle 40 is moved from the retaining position to the loading position the tension within the tensioned portion 26 of the strap 20 is increased. This is because the first side 44*a* of the pivot member 44 is longer than the second side 44*b* of the pivot member 44. Therefore, in order to move the retaining buckle 40 from the retaining position to the loading position a lifting force must be applied to the tongue 48 of the retaining buckle 40. This ensures that the retaining buckle 40 does not move from the retaining position accidentally, thereby inadvertently releasing the free portion 28 of the strap.

When the retaining buckle 40 has been rotated by approximately 90°, the tensioned portion 26 of the strap 20 rests against the second side 44*b* of the pivot member 44 and the fourth side 44*d* of the pivot member 44 rests against the cylinder 1. Since the fourth side 44*d* of the pivot member 44 fits against the cylinder 1, the retaining buckle 40 is prevented from moving back to the retaining position. This allows the free end 24 of the free strap portion 28 to be inserted into the retaining slot 46. To return the retaining buckle 40 to the retaining position, a small force is applied to the tongue 48 and the tension in the tensioned portion 26 of the strap 20 acting on the pivot member 44 returns the retaining buckle 40 to the retaining position. The retaining buckle 40 uses the tension within the tensioned retaining portion 26 of the strap 20 to provide a snap-type arrangement.

The invention claimed is:

1. A harness for breathing apparatus comprising:

a structural support member for supporting a cylinder of breathable gas;

a gas-cylinder retaining assembly coupled to the structural support member for retaining a cylinder of breathable gas on the structural support member; and a cylinder of breathable gas supported by the structural support member and retained thereto by the gas-cylinder retaining assembly;

the gas-cylinder retaining assembly comprising:

a strap coupled to the structural support member and having a retaining portion passing around at least a portion of the cylinder;

a tensioning device configured to tighten the retaining portion of the strap around the cylinder, the tensioning device maintaining the retaining portion of the strap in tension around the cylinder, wherein a free portion of the strap having a free end extends from the tensioning device; and a retaining buckle configured to retain the free portion of the strap, the retaining buckle comprising:

a positioning slot through which the retaining portion of the strap passes;

a pivot member which is located between the cylinder of breathable gas and the retaining portion of the strap; and a retaining slot configured to receive the free end of the strap;

wherein the retaining buckle is pivotable about the pivot member between at least a loading position in which the free end of the strap can be inserted into the retaining slot, and a retaining position in which at least part of the free portion of the strap is held between the retaining buckle and the retaining portion of the strap.

2. A gas-cylinder retaining assembly according to claim 1, wherein the pivot member of the buckle defines a side of the positioning slot.

3. A gas-cylinder retaining assembly according to claim 1, wherein the positioning slot and the retaining slot are separate and/or parallel and/or laterally spaced from one another.

4. A gas-cylinder retaining assembly according to claim 1, wherein the pivot member is shaped such that the force acting on the pivot member due to the tension in the retaining portion of the strap causes the retaining buckle to be held in the retaining position.

5. A gas-cylinder retaining assembly according to claim 1, where in the tension in the retaining portion of the strap is increased when the retaining buckle is moved from the retaining position to the locating position.

6. A gas-cylinder retaining assembly according to claim 1, wherein the shape of the pivot member is substantially that of a rectangular prism.

7. A gas-cylinder retaining assembly according to claim 1, wherein at least a portion of the retaining buckle is textured so as to grip the strap.

8. A gas-cylinder retaining assembly according to claim 1, wherein the retaining buckle is curved so as to follow the surface contour of the gas-cylinder when the retaining buckle is in the retaining position.

9. A gas-cylinder retaining assembly according to claim 1, wherein the retaining buckle is made from plastic.

* * * * *